US010773914B2

(12) United States Patent
Schlittenbauer et al.

(10) Patent No.: US 10,773,914 B2
(45) Date of Patent: Sep. 15, 2020

(54) PREVENTING THE FLUTTERING OF THE TAIL IN FILM PRINTING

(71) Applicant: MANROLAND GOSS WEB SYSTEMS GMBH, Augsburg (DE)

(72) Inventors: Johann Schlittenbauer, Aichach (DE); Gerhard Pichlmair, Neusaess (DE); Lorenz Kramer, Muenster (DE)

(73) Assignee: MANROLAND GOSS WEB SYSTEMS GMBH (DE)

( * ) Notice: Subject to any disclaimer, the term of this patent is extended or adjusted under 35 U.S.C. 154(b) by 0 days.

(21) Appl. No.: 16/368,597

(22) Filed: Mar. 28, 2019

(65) Prior Publication Data

US 2019/0308838 A1 Oct. 10, 2019

(30) Foreign Application Priority Data

Apr. 6, 2018 (DE) ..... 10 2018 108 168

(51) Int. Cl.
*B65H 19/18* (2006.01)
*B65H 19/20* (2006.01)
(Continued)

(52) U.S. Cl.
CPC ..... *B65H 19/181* (2013.01); *B41F 25/00* (2013.01); *B65H 19/102* (2013.01);
(Continued)

(58) Field of Classification Search
CPC ..... B65H 19/181; B65H 2301/46152; B65H 19/107; B65H 19/1821; B65H 19/20; B65H 2301/5142; B65H 2301/5162
See application file for complete search history.

(56) References Cited

U.S. PATENT DOCUMENTS 2,311,626 A * 2/1943 Cline ..... B65H 19/1821 242/554.3
3,554,829 A * 1/1971 Luckett, Sr. ..... B65H 19/102 156/157

(Continued)

FOREIGN PATENT DOCUMENTS

DE 44 41 447 C1 5/1996
WO 9325460 A1 12/1993
WO 2015173275 A1 11/2015

OTHER PUBLICATIONS

Europäisches Patentamt (European Patent Office); Europäischer Recherchenbericht (European Search Report), dated Sep. 18, 2019 (dated Sep. 18, 2019), 6 pages, Munchen, Deutschland (Munich, Germany).

*Primary Examiner* — Mark A Osele
(74) *Attorney, Agent, or Firm* — Christopher C. Dremann, P.C.; Christopher C. Dremann

(57) ABSTRACT

A method and device for carrying out a reel splice to avoid the fluttering of tails makes it possible to allow the tail to also adhere across its entire length, in particular on a web with high mechanical strength. When using a fluid-repelling substrate, an adhesive-free liquid is applied to a new roll and/or to at least a portion of the side of the tail facing the web. The method and device can be used in reel splicers which process fluid-repellent substrates, such as for example plastic films, metal films or laminated laminates, so that a sticking out or fluttering of the tail is avoided.

18 Claims, 5 Drawing Sheets

(51) Int. Cl.
*B41F 25/00* (2006.01)
*B65H 19/10* (2006.01)

(52) U.S. Cl.
CPC ..... *B65H 19/1821* (2013.01); *B65H 19/20* (2013.01); *B65H 2301/4615* (2013.01); *B65H 2301/5142* (2013.01); *B65H 2301/5162* (2013.01); *B65H 2801/21* (2013.01)

(56) References Cited

U.S. PATENT DOCUMENTS 4,009,841 A * 3/1977 Matalia ..... B65H 19/1815
242/555.6
4,024,302 A * 5/1977 Takagi ..... B05D 3/12
427/290
4,269,647 A * 5/1981 Verkinderen ..... B05C 5/007
156/157
5,356,496 A * 10/1994 Lincoln ..... B65H 19/102
156/159
6,547,179 B1 * 4/2003 Klas ..... B65H 19/107
242/554.2
6,726,614 B1 * 4/2004 Klas ..... B65H 19/20
242/553
8,138,449 B2 * 3/2012 Matsuo ..... B23K 26/211
219/121.64

* cited by examiner

Fig. 1 [PRIOR ART]

Fig. 2 [PRIOR ART]

Fig. 3 [PRIOR ART]

Fig. 5
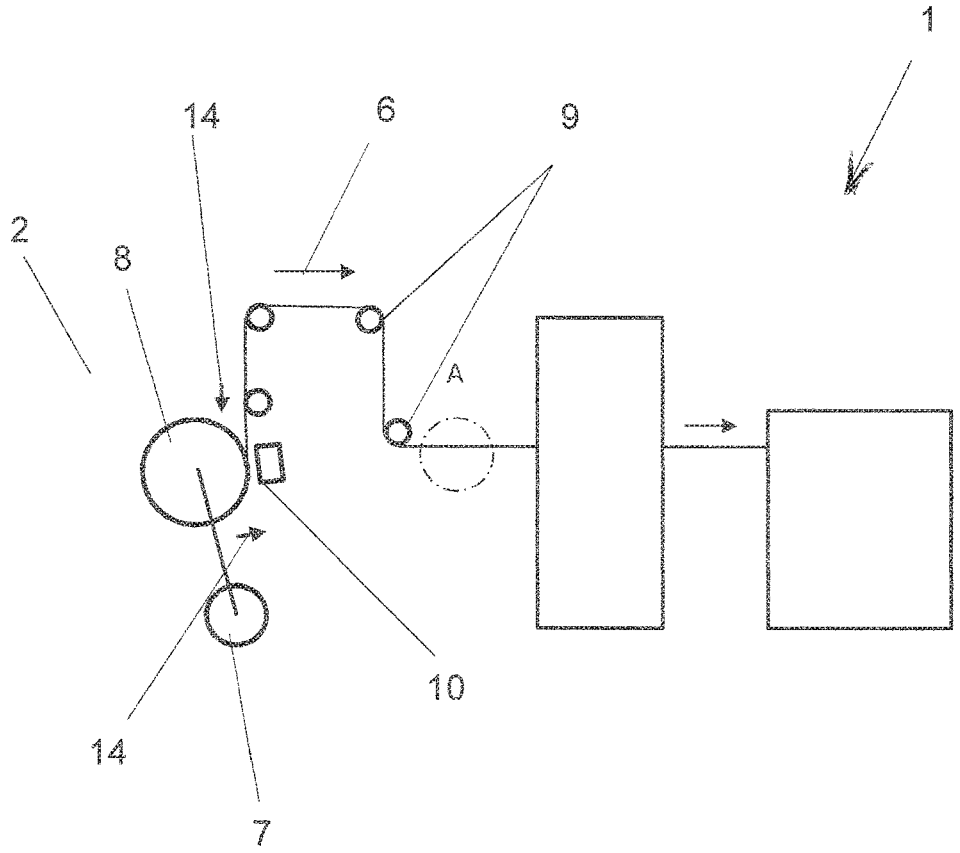
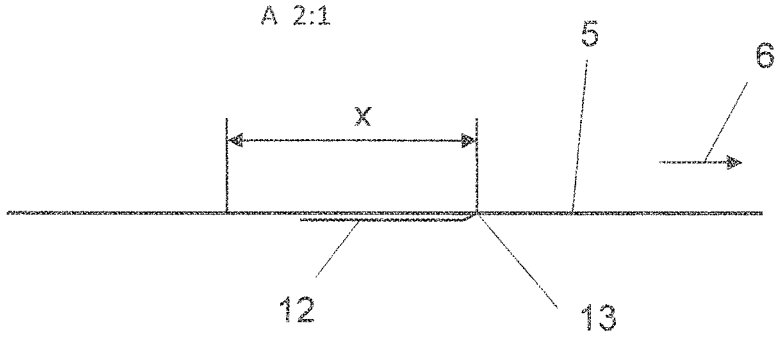

PREVENTING THE FLUTTERING OF THE TAIL IN FILM PRINTING

FIELD OF THE INVENTION

The invention relates to a method for avoiding that a tail sticks out, hangs down and flutters after a reel splice in a web-fed printing press to avoid damages to the tail and thus also to the web-shaped printing material, as well as to parts of the corresponding printing press. The invention furthermore relates to a device for carrying out this method.

BACKGROUND AND RELATED ART

In the case of web-fed printing presses, the printing material is printed as web in the printing press and is additionally processed in many corresponding variations. The printing material is fed to the web-fed printing press in that the web-shaped printing material is unwound from a roll of the printing material. For this purpose, the roll is clamped into a device, in which the roll is unwound and the unwound printing material web is fed to the downstream parts of the web-fed printing press. Unwinders, dispensers, roll stands or reel splicers in different constructions are known from the prior art as devices for receiving a printing material roll, wherein the technical definitions or the technical differences, respectively, between the different names are fluid and can vary. Only the term reel splicer will be used below for all of these different concepts of unwinders, dispensers, roll stands or reel splicers.

The method according to the invention also applies to other processing processes and processing machines, in the case of which a web-shaped fluid-repellent material is processed in a different manner, without necessarily being printed, such as, for example, for cutting open webs, wrapping around the rolls, etc.

Due to the fact that only a limited amount of a web can be unwound from a roll, it is required for an uninterrupted production process that the web, which runs off from the so-called old roll is adhered to a new web of a so-called new roll. For this purpose, the prepared web start of the new roll, which is provided with an adhesive strip, is pressed against the web of the old roll, which runs off, so that the web of the new roll is adhered to the web, which runs off from the old roll. After the adhering process, the web of the old roll, which runs off, is severed, so that the printing material web is unwound exclusively from the new roll after the splicing process.

The adhering of the web of the new roll to the web of the old roll, which runs off, can either take place when the web stands still at least in the reel splicer region, or this takes place fully automatically when the web runs, wherein this is preferably possible at maximally possible production speed.

Due to the fact that a time difference is at hand between the adhering of the web to the new roll and the severing of the web in the case of correspondingly high web speeds, a tail is thus created as part of the web of the old roll, which is connected to the web of the new roll by means of the adhesive point. The tails usually have a length of approx. 10 to approx. 60 centimeters.

Due to the fact that these tails are connected with the adhesive point to the web of the new roll only at its leading end, viewed in the web running direction, said tail can hang down for example, provided that the tail is arranged on the underside of the web, or the tail can detach at least partially from the web, in particular with the trailing edge in response to corresponding wrapping around rollers, etc. It is thereby either possible that the web is damaged by the mechanical resistance when the tail strikes against a part of the printing press and can tear, or components of the printing press, which are arranged in the region of the web, are damaged.

There is a significant risk of a production interruption due to a web tear caused thereby or of damages to machine components, in particular when film-like printing materials, such as, for example, plastic films, metal films or other comparable materials with a relatively high mechanical tear strength are processed.

A solution is known from DE 44 41 447 C1, by means of which tails, which hang down freely in this way or which detach, can at least be reduced in their effective length in that not only an adhesive strip for forming the adhesive point is attached to the web as connection of the web of the old roll with the web of the new roll, but in that an additional adhesive is applied in the region downstream from the adhesive spot.

Due to the fact, however, that the length of the tail varies for different reasons in practice—this is a function, for example, of the web speed during the adhering process, the position of the reflex marks to the adhesive point, the reaction speed of the adhering and cutting device—the length of the tail can be limited maximally with the solution known from DE 44 41 447 C1, because the adhesive application may under no circumstances go beyond the region of the tail so as to avoid web winders, web tears, damages to or contaminations of parts of the printing press, etc. This is so, because if a corresponding, applied adhesive is not covered by the tail, it adheres to the component or to the part, such as, for example a guide roller, draw roller, pressure roller or on a printing cylinder and leads to significant impairments, such as windings, blockage, web tears as well as to contamination there due to adhesion together with the web.

OBJECT AND SUMMARY OF THE INVENTION

The invention is thus based on the object of creating a solution, which makes it possible to allow the tail to also adhere across its entire length in particular on a web with a high mechanical strength.

According to the invention, the object is solved in that, when using a fluid-repellent substrate, an adhesive-free liquid is applied to the new roll and/or to the side of the tail facing the web, at least in a partial surface of the tail.

An embodiment of the method has the advantage that the tail can thus be fixed across its entire length to the web, which runs off, because the adhesive-free liquid, which is thus generally not inherently adhesive and runs on the tail and/or on the web, which runs off from the new roll, can also be applied to the web in regions, which are no longer covered by the tail, because the web, to which the liquid is applied, provided that it comes into contact with other parts of the printing press, usually does not cause any interferences, web tears, windings or other production interferences. Even if one or both web sides are printed by means of the offset printing method, the application of the liquid beyond the region of the tail does not lead to production interferences. In spite of a fluctuation of the length of the tail, which is present as a result of the method, a fixation of the tail across the entire extension thereof can thus be ensured in a reliable manner.

In an advantageous embodiment of the invention, water or an aqueous solution is used as liquid. In the case of the aqueous solution, additives are added to the water, for example surfactants, so as to reduce for example the surface tension of the liquid.

In a further advantageous embodiment, a hydrocarbon-based liquid is used, such as, for example low-viscous oils, oil of average to high viscosity or solvent-like substances. The wettability is also ensured hereby. Hydrocarbon-based liquids are advantageous in particular when for example printing methods are used, in the case of which water or an aqueous solution on the substrate would lead to an impairment of the printing process.

In a further advantageous embodiment, an emulsion of water or an aqueous solution and a hydrocarbon-based liquid can also be used. Such combinations provide for an optimal adaptation of the wettability as well as of the capillarity of the liquid to the substrate and, if necessary, to the processing and/or printing process with regard to the compatibility on the liquid.

In a particularly advantageous embodiment of the invention, the liquid is applied at least across the entire surface of the tail. The application can hereby take place either to the adhesive surface or to the web, which runs off from the new roll.

The application of the liquid, if the liquid is applied to the web, can also take place in a region, which is no longer covered by the tail, even in the case of maximum length thereof. It is thus ensured that, regardless of the actual length of the tail, even in the case of the maximum length of the tail, the latter adheres holohedrally to the web and does not have any edges or regions, which stick out.

BRIEF DESCRIPTION OF THE DRAWING FIGURES

Exemplary embodiments of the invention are described in the following detailed description and shown in the accompanying drawing figures, without being limited thereto.

FIG. 5 shows a schematic illustration of a printing press comprising the reel splicer according to the invention immediately after the reel splice.

DETAILED DESCRIPTION OF EXEMPLARY EMBODIMENTS

Figure 1:
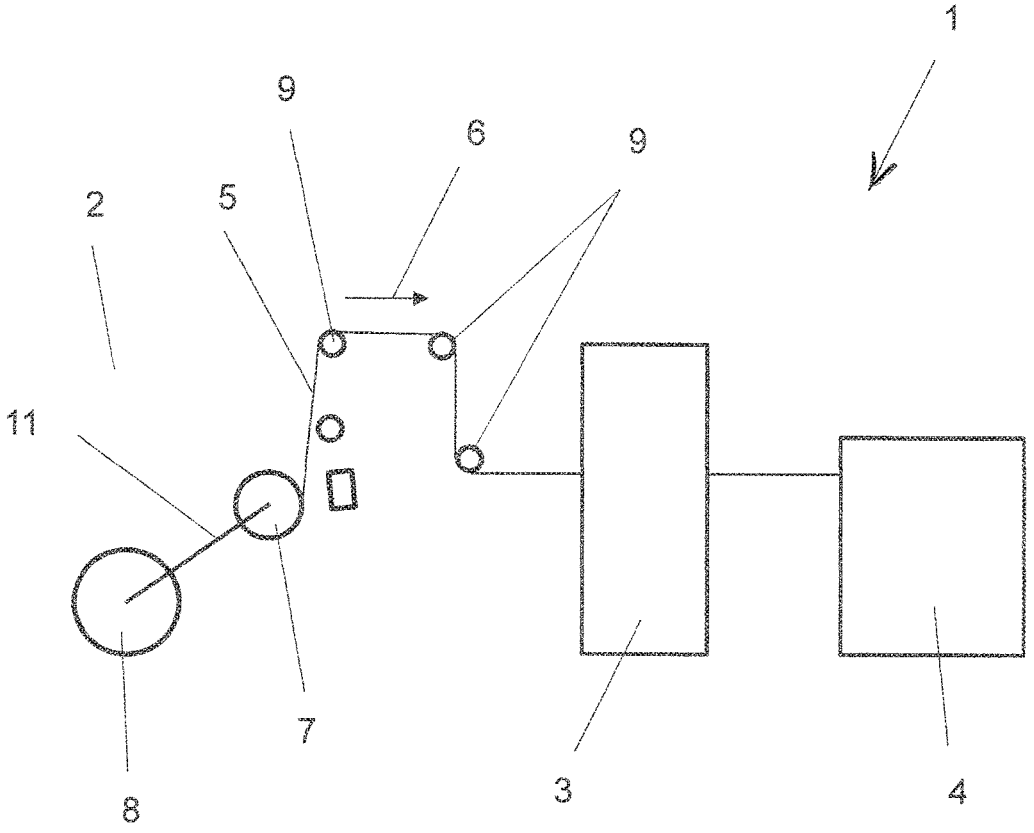
FIG. 1 shows a schematic illustration of a printing press according to the prior art.

FIG. 1 shows the schematic setup of a web-fed printing press 1, in the case of which the web-shaped substrate is unwound from a rotating old roll 7 in the reel splicer 2. The old roll 7 is supported in non-illustrated clamping mandrels and is either driven in response to the unwinding of the web 5, or is driven and braked, only braked for building up a web tension, or is simply dragged. FIG. 1 shows a schematic sketch of a reel splicer 2, as it is usually used in the case of so-called flying reel splices, but the invention is also possible in the case of so-called shutdown reel splicers or dispensers.

The unwound web 5 is usually also guided via various web elements, such as deflection rollers 9, the web 5 can thereby alternatively be oriented at right angles to the web running direction 6. It is also possible to bring driven deflection rollers 6 or draw rollers, which are not graphically shown, in contact with the web 5, in order to be able to influence the web tension in the region of the reel splicer 2.

The web 5, which is unwound from the old roll 7 is fed to the subsequent components of the processing machine—after passing through the remaining part of the reel splicer 2, viewed in the web running direction. In the illustrated example of a web-fed printing press 1, this is usually at least one printing unit, by means of which the web 5 is printed at least on one side, for example in the offset, in the intaglio printing, in the flexographic or in a digital printing method.

The web 5, which is thus printed at least on one side and at least monochromatically, is fed to a post-processing 4. This can generally be a cross-cutting device or a folding device, for example re-winders are used in the case of the misprinting or processing of films or film-like substrates, such as for example plastic films, metal films or laminates, for example in the packaging printing.

Due to the fact that the old roll 7 can only have a limited amount of the web-shaped substrate, a new roll 8, which is provided with a double-sided adhesive tape for the preparation of adhesion prior to or after the reel splice, is introduced into the reel splicer 2—mostly during the production—to ensure a more or less uninterrupted production.

The reel splicer 2, which is illustrated in an exemplary manner in FIG. 1, can receive two rolls on its support arm 11, but reel splicers 2 comprising more than two receivable rolls are also known. The number of the rolls as well as the arrangement of the old roll 7, which runs off, as well as of the new roll 8, is irrelevant for the present invention and thus does not represent a limitation.

Figure 2:
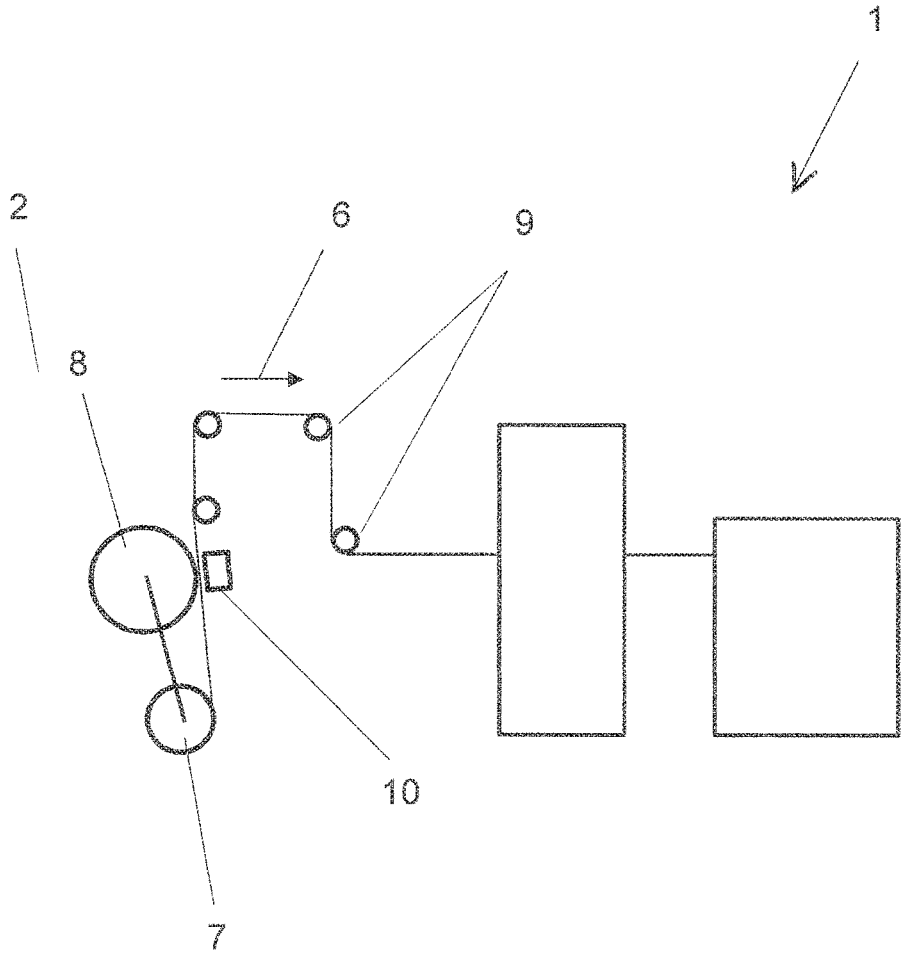
FIG. 2 shows a schematic illustration of a printing press directly prior to the reel splice according to the prior art.

FIG. 2 illustrates the web-fed printing press 1 according to FIG. 1, but at a point in time, in which the old roll 7 approaches its minimum diameter. The support arm 11 pivots about a horizontal axis, so that the new roll 8 is brought into a position, in which the adhesion-preparing new roll 8, which is accelerated to the web speed, can be brought into contact with the web 5, which runs off the old roll 7. The so-called splice head 10, which comprises a pressure roller and a cutting knife, is hereby brought into the immediate vicinity of the web 5, which runs off the old roll 7.

Even if FIG. 2 illustrates the situation directly prior to a reel splice by means of a flying reel splicer 2 or auto-paster, the present invention can also be transferred to other types of reel splicers 2, which are not graphically illustrated, such as for example shutdown reel splicers.

If the old roll 7 reaches a predetermined diameter for splicing and if the new roll 8 has the circumferential speed, which is exactly identical to the web speed, for example a pressure roll or pressure brush pushes the web 5, which runs off the old roll 7, against the new roll 8, so that the web 5, which runs off the old roll 7, is connected to the web 5 of the new roll 8 by means of an adhesive bond by means of the double-sided adhesive tape, the cutting knife of the splice head 10 severs the web 5, which runs off the old roll 7 immediately after that.

Figure 3:
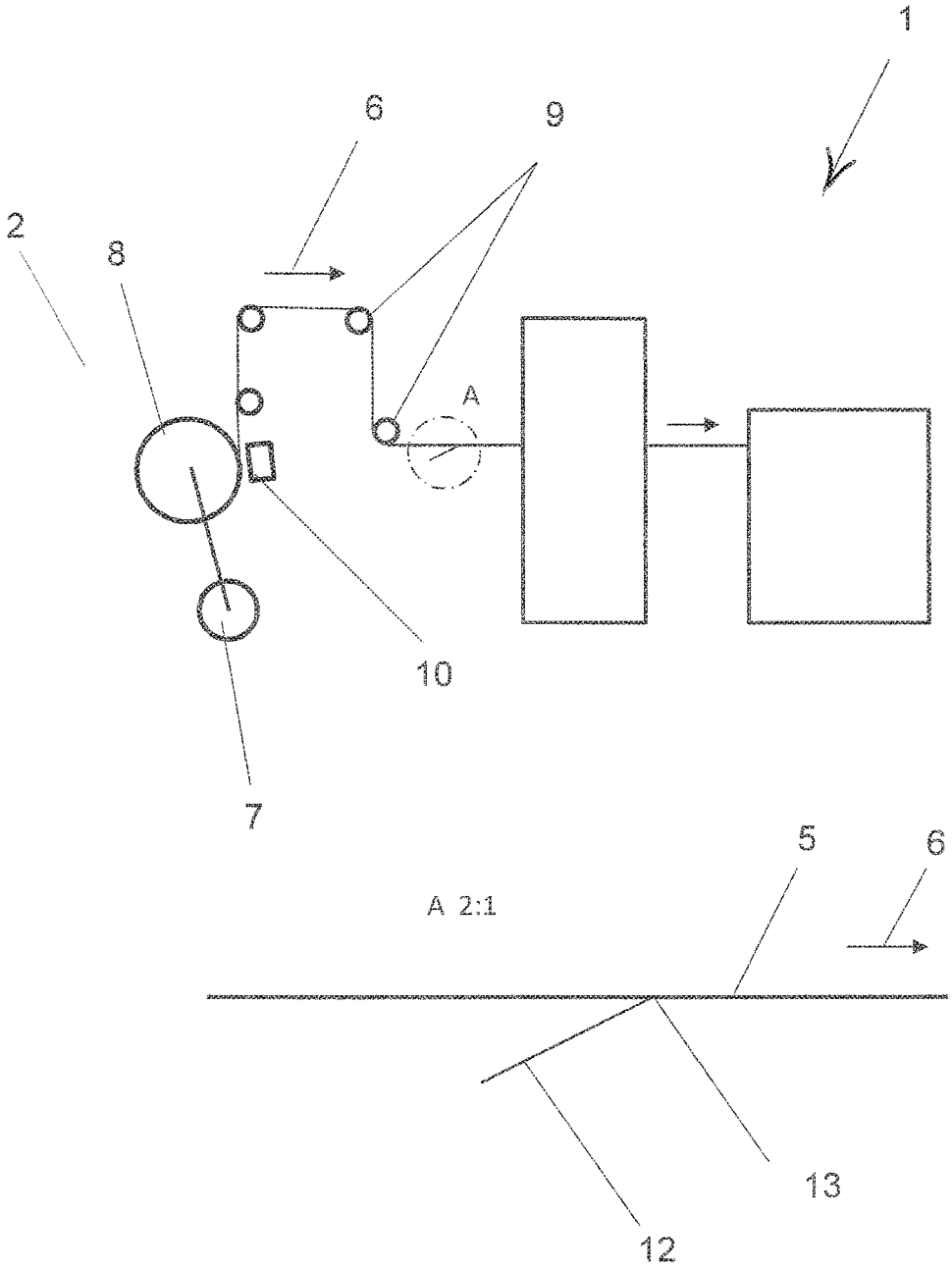
FIG. 3 shows a schematic illustration of a printing press directly after a reel splice according to the prior art.

FIG. 3 shows the web-fed printing press 1 symbolically immediately after the reel splice was made, wherein the web 5 is unwound from the new roll 8 and is fed to the parts of the printing press 1.

As can be seen in FIG. 3, a tail 12 is created by the severing of the web 5, which runs off the old roll 7, albeit only for a very short time after the web 5 is adhered to the new roll 8, which tail is connected to the web 5 only at the adhesive point 13 and which is thus no longer connected to the web 5 across its extension in the web-running direction 6, which represents the length of the tail 12.

The tail 12 created in this way, which is actually the remainder of the web 5, which runs off the old roll 7, starting at the adhesive point 13, can thus either hang down due to the force of gravity, so that it can come into contact or comes into contact, respectively, with parts of the printing press 1 due to its length of approx. 20 to approx. 500 mm.

It is also possible that even though the tail 12 bears on the web 5 in response to higher web speeds or lies on the web 5, provided that the tail 12 is attached to the web top side, the tail 12 can or will stick out from the web 5 either in the case of very stiff substrates or in response to the deflection of the web 5, for example on deflection rollers 9.

If this tail 12 comes into contact with parts or components of the printing press 1, either portions of the tail 12 can tear off and web shreds can form, which can cause production interferences, or the web 5 can rip or tear completely.

In particular, in the case of substrates of a high mechanical strength, such as for example plastic films or laminates, it is further possible that parts or components of the printing press 1 are affected as a result of a tail 12, which sticks out.

Even though devices for detaching such tails 12 are known from the prior art, they fail in response to web speeds, which are not too high, and lose their functionality in particular in the case of substrates with high mechanical strength.

Figure 4:
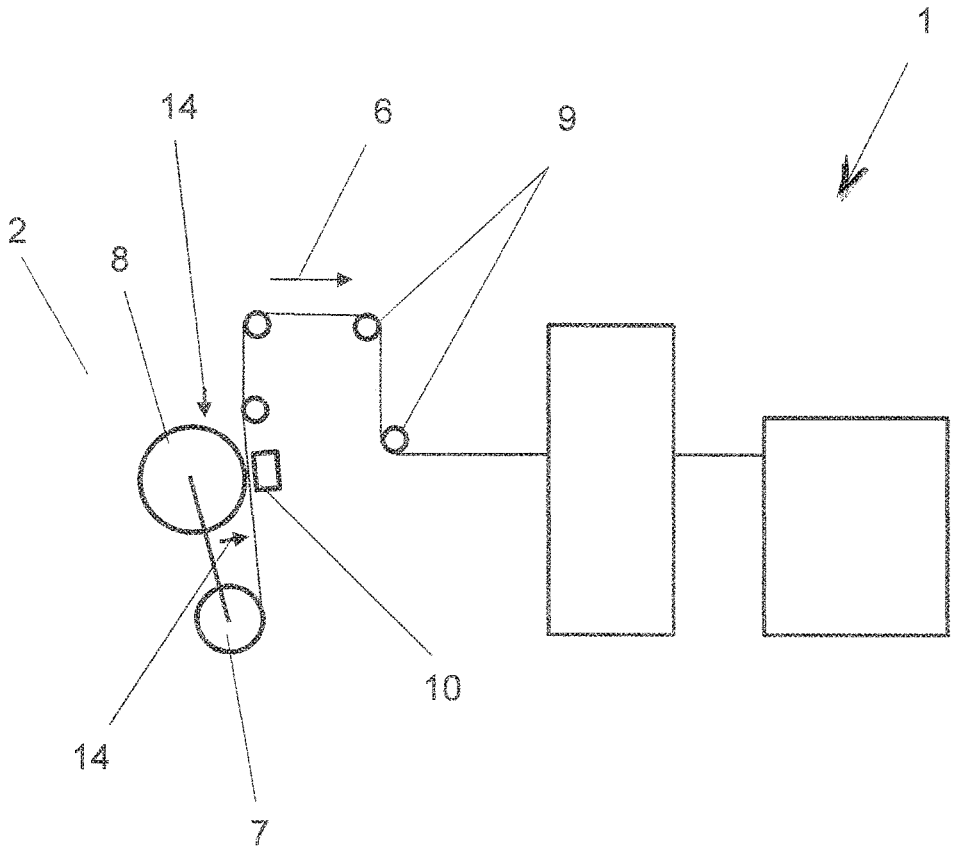
FIG. 4 shows a schematic illustration of a printing press comprising the reel splicer according to the invention immediately prior to the reel splice.

FIG. 4 shows a printing press 1 comprising a reel splicer 2 for carrying out the method according to the invention. Said reel splicer optionally comprises one or a plurality of application devices 14 for applying adhesive-free liquid to the new roll 8 and/or to the side of the tail 12 facing the web 5.

In the case of a method for carrying out the reel splice according to the invention, an adhesive-free liquid is applied to the new roll 8 and/or to the side of the tail 12 facing the web 5 at least to or in a partial surface of the tail 12 at the point in time when the web 5, which runs off the old roll 7, which rolls off, of a substrate to be processed, is pressed against the web, which is embodied with the adhesive point 13—for example in the form of a substantially double-sided adhesive tape, or, as a function of the web speed, a few seconds to a few hundredth of a second prior to pressing the web 5 against the new roll 8 or to the web 5, which is wound onto the new roll 8, respectively, for forming an adhesive bond between the web 5, which runs off the old roll 7, and the new roll 8 or the web 5, respectively, which is wound onto the new roll 8, and the subsequent severing of the web 5, which runs off the old roll 7, wherein at least one tail 12 with an extension from the adhesive point 13 to the cutting edge on the adhesive spot 13 remains as a result of the severing of the web 5, which is unwound from the old roll 7.

The film of the adhesive-free liquid, which is preferably applied thinly in this way, wets the surface of the web 5 and/or of the tail 12 resulting therefrom in the case of the use of a substrate, which is fluid-repellent and thus does not absorb the liquid, such as for example plastic films, metal films, laminates with cover layers of fluid-repellent material, such as for example webs (5) laminated with plastic or metal film of non-absorbent or absorbent material or for example impregnated substrates of non-absorbent or generally absorbent material, and can no longer escape when placing the tail 12 to the corresponding web side—in particular after pressing on the tail 12—for example by revolving of a deflection roller 9. Due to the capillarity, the liquid is held in the gap, which is thus very thin, between the web 5 and the tail 12 or is also distributed evenly there, respectively, so that a holohedral liquid film remains at least in the regions of the liquid application in particular in response to a spreading or compression of the web 5 in the region of the tail 12, for example after passing through a deflection roller 9 or a roller pair placed against one another.

Due to the capillary effect and the van-der Waals forces of the used, albeit adhesive-free liquid, the tail 12 thus adheres to the web 5 with a relatively strong adhesion, as long as a liquid film is present. If this liquid film dries or if the liquid diverges out of the substrate or into the substrate, which, however, usually takes longer than the pass-through time of a point through a corresponding printing press 1—such a pass-through time is only a few seconds as a function of the press configuration and the web speed—the tail 12 is thus no longer fixed to the web 5.

FIG. 5 shows the web-fed printing press 1 immediately after the reel splice and the application of the liquid according to the invention to at least a partial surface of the tail 12, so that the tail 12 adheres to the web 5 by means of the van-der Waals forces between the web 5 and the liquid on the one hand and the liquid and the tail 12 on the other hand.

A tail 12, which is fixed to the web 5 in this way, can be guided with the web 5 through the printing press 1 such that impairments of the production, damages to the web 5 or damages to components or parts of the printing press 1 occur.

Due to the holding force in the form of the van-der-Waals force of the liquid on the web 5, which is low in contrast to adhesives or adhesive-containing liquids, no impairments whatsoever to the production thus result for example due to web tears, windings or contaminations of web-guiding elements, when the liquid is applied to the web 5 in a region, which is larger than the region, which is covered by the tail 12 located on the web 5.

If the liquid is for example applied to the web 5 in a region of the extension x, viewed in the web-running direction 6, the liquid is not covered completely by the tail 12. If this region of the web 5 comes into contact with a web-guiding part, such as for example a deflection roller 9 or a printing cylinder, the web-guiding part is wetted with the liquid, but this does not lead to any impairments of the production, such as for example web tears, windings or contaminations with adhesives, which are difficult to remove for the most part, due to the effect of the adhesive-free liquid, which is generally not adhesive.

The liquid is thus advantageously applied at least across the entire surface of the tail 12. The application can hereby either take place to the adhesive surface or to the web 5, which runs off the new roll 8. It is also possible, however, to apply the liquid in a region, which is spaced apart from the adhesive point 13, i.e. that the application of the liquid is applied only in the rear region of the tail 12, viewed in the web-running direction 6.

The liquid can also be applied holohedrally or in an interrupted manner in extension across the web width, for example in at least one strip parallel to the web-running direction 6 or in a punctiform manner, that is, also interrupted in the extension of the web-running direction.

Water or an aqueous solution can be used as liquid. In the case of the aqueous solution, additives are added to the water, for example surfactants, to reduce for example the surface tension of the liquid.

However, a hydrocarbon-based liquid, such as for example low-viscous oils, oils with average or high viscosity or solvent-like or solvent-containing substances, can also be used as liquid. The wettability is also ensured thereby.

Hydrocarbon-based liquids are advantageous in particular when for example printing methods are used, in the case of which water or an aqueous solution on the substrate would lead to an impairment of the printing process.

An emulsion of water or an aqueous solution and a liquid of hydrocarbon can also be used for application to the web 5 and/or to the tail 12. Such combinations provide for an optimal adaptation of the wettability as well as of the capillarity of the liquid to the substrate and, if necessary, to the processing and/or printing process with regard to the compatibility on the liquid.

As already specified above, the application of the liquid can take place when the web 5 is stationary as well as when the web 5 moves immediately prior to the reel splice to the web 5, which rolls off the old roll 7 and/or to the web 5, which is wound onto the new roll 8. In the case of the liquid application when the web 5 is stationary, this can either take place in the case of a shutdown reel splicer when the web 5 is stationary inside the reel splicer 2, while the production takes place by removing the web 5 from a paper storage.

It is also possible, however, which is in particular the case with reel splicers 2, which are designed in a technically simple manner, or dispensers, that the printing press 1 needs to be stopped for re-adhering the web 5 from the old roll 7 to the new roll 8, so that a stationary web 5 already results therefrom, so that the liquid can be applied to the web 5 and/or to the new roll 8 either manually, for example by means of a spray bottle preferably comprising a sprayer, by means of a sponge or a cloth, or by means of an application device 14 within a limited time window prior to the reel splice.

In the case of highly automated reel splicers 2 with automatic execution of the reel splice, the liquid is applied either to the web 5, which runs off the old roll 7, or to the new roll 8 in response to corresponding web speed, so that an application of the liquid—in particular to the new roll 8—has to take place immediately prior to the reel splice and is essentially only possible by means of an application device 14, which is installed in the reel splicer 2.

Such an application device 14 can either be a device, which is embodied with a liquid reservoir, such as for example a liquid-storing border, such as a wetted cloth or a sponge, which is attached to the new roll 8 and/or to the web 5, which runs off, so as to be temporally controlled accordingly. It is also possible, however, to embody the application device 14 as a sprayer comprising at least one spray nozzle, which traverses the substrate in extension of the web or roll width, respectively, or to design it as spray pipe comprising a plurality of nozzles of the at least two outlet openings across the width of the processing web 5. In the case of a spray pipe with extension across the entire web width, the liquid application can thus be temporally controlled very accurately and the position as well as the length of the liquid application can thus be controlled via the clocking of one or a plurality of corresponding valves.

It goes without saying that such application devices 14 can also be used in shutdown reel splicers or so-called dispensers for the manual re-adhesion of the web 5 from the old roll 7 to the new roll 8, in order to carry out the liquid application in an even, reproducible and automated or partially automated manner.

Regardless of the type of the liquid application, it is advantageous when the tail 12 is pressed against the web 5, which runs off the new roll 8, by means of a pressing device after the application of the liquid, which can take place for example by means of a deflection roller, a web-guiding roller or draw roller with attached impression cylinder, a draw roller pair attached to one another, or an attached pair of printing cylinders.

That which is claimed is:

1. A method for carrying out a reel splice, comprising:
- providing a web that runs off an old roll of a fluid-repellent substrate;
- pressing the web that runs off the old roll against an adhesive point of a new roll of the fluid-repellent substrate;
- forming an adhesive connection between the web that runs off the old roll and the new roll;
- severing the web that runs off the old roll at a cutting edge such that at least a portion of a tail with an extension from the adhesive point to the cutting edge remains on the web that runs off the old roll beyond the adhesive point; and
- applying an adhesive-free liquid to the new roll beyond the adhesive point.

2. The method according to claim 1, wherein the adhesive-free liquid comprises water or an aqueous solution.

3. The method according to claim 1, wherein the adhesive-free liquid comprises a hydrocarbon-based liquid.

4. The method according to claim 1, wherein the adhesive-free liquid comprises an emulsion of water or an aqueous solution and a hydrocarbon-based liquid.

5. The method according to claim 1, wherein the adhesive-free liquid is applied when the web is stationary.

6. The method according to claim 1, wherein the adhesive-free liquid is applied when the web is moving.

7. The method according to claim 1, wherein the adhesive-free liquid is applied by a sprayer comprising at least one spray nozzle.

8. The method according to claim 1, wherein the adhesive-free liquid is applied by a strip comprising a liquid-storing border.

9. The method according to claim 1, further comprising pressing the tail against a web that runs off the new roll by a pressing device after applying the adhesive-free liquid.

10. A reel splicer for carrying out a reel splice, the reel splicer comprising an application device configured to carry out a reel splice according to the method of claim 1.

11. A method for carrying out a reel splice, comprising:
- providing a web that runs off an old roll of a fluid-repellent substrate;
- pressing the web that runs off the old roll against an adhesive point of a new roll of the fluid-repellent substrate;
- forming an adhesive connection between the web that runs off the old roll and the new roll;
- severing the web that runs off the old roll at a cutting edge such that at least a portion of a tail with an extension from the adhesive point to the cutting edge remains on the web that runs off the old roll beyond the adhesive point; and
- applying an adhesive-free liquid to at least a portion of a surface of a side of the tail facing the new roll.

12. The method according to claim 11, wherein the adhesive-free liquid comprises at least one of an emulsion of water or an aqueous solution and a hydrocarbon-based liquid.

13. The method according to claim 11, further comprising pressing the tail against a web that runs off the new roll by a pressing device after applying the adhesive-free liquid.

14. A reel splicer for carrying out a reel splice, the reel splicer comprising an application device configured to carry out a reel splice according to the method of claim 11.

15. A method for carrying out a reel splice, comprising:

providing a web that runs off an old roll of a fluid-repellent substrate;

pressing the web that runs off the old roll against an adhesive point of a new roll of the fluid-repellent substrate;

forming an adhesive connection between the web that runs off the old roll and the new roll;

severing the web that runs off the old roll at a cutting edge such that at least a portion of a tail with an extension from the adhesive point to the cutting edge remains on the web that runs off the old roll beyond the adhesive point; and applying an adhesive-free liquid to the new roll beyond the adhesive point and to at least a portion of a surface of a side of the tail facing the new roll.

16. The method according to claim 15, wherein the adhesive-free liquid comprises at least one of an emulsion of water or an aqueous solution and a hydrocarbon-based liquid.

17. The method according to claim 15, further comprising pressing the tail against a web that runs off the new roll by a pressing device after applying the adhesive-free liquid.

18. A reel splicer for carrying out a reel splice, the reel splicer comprising an application device configured to carry out a reel splice according to the method of claim 15.

* * * * *